US012392006B2

(12) United States Patent
Doan et al.

(10) Patent No.: US 12,392,006 B2
(45) Date of Patent: Aug. 19, 2025

(54) HIGH-STRENGTH STEEL SHEET AND METHOD FOR MANUFACTURING THE SAME

(71) Applicant: JFE Steel Corporation, Tokyo (JP)

(72) Inventors: Thi Huyen Doan, Tokyo (JP); Hiroshi Hasegawa, Tokyo (JP); Hideyuki Kimura, Tokyo (JP)

(73) Assignee: JFE Steel Corporation, Tokyo (JP)

( * ) Notice: Subject to any disclaimer, the term of this patent is extended or adjusted under 35 U.S.C. 154(b) by 71 days.

(21) Appl. No.: 18/282,299

(22) PCT Filed: Mar. 15, 2022

(86) PCT No.: PCT/JP2022/011492
§ 371 (c)(1),
(2) Date: Sep. 15, 2023

(87) PCT Pub. No.: WO2022/209838
PCT Pub. Date: Oct. 6, 2022

(65) Prior Publication Data

US 2024/0141452 A1 May 2, 2024

(30) Foreign Application Priority Data

Mar. 31, 2021 (JP) ..... 2021-062131

(51) Int. Cl.
*C21D 9/46* (2006.01)
*C21D 1/84* (2006.01)
(Continued)

(52) U.S. Cl.
CPC ..... *C21D 9/46* (2013.01); *C21D 1/84* (2013.01); *C21D 6/002* (2013.01); *C21D 6/005* (2013.01);
(Continued)

(58) Field of Classification Search
None
See application file for complete search history.

(56) References Cited

U.S. PATENT DOCUMENTS 9,222,155 B2 12/2015 Nakamura et al.
2015/0376730 A1 12/2015 Shuto et al.
(Continued)

FOREIGN PATENT DOCUMENTS

CN 102803540 A 11/2012
CN 103108971 A 5/2013
(Continued)

OTHER PUBLICATIONS

The Extended European Search Report issued Jun. 25, 2024, by the European Patent Office in corresponding European Patent Application No. 22 780 059.6. (9 pages).
(Continued)

*Primary Examiner* — Daniel J. Schleis
(74) *Attorney, Agent, or Firm* — Buchanan Ingersoll & Rooney PC

(57) ABSTRACT

The high-strength steel sheet has a chemical composition with MSC value in the range of 2.7% to 3.8% by mass defined by a specific formula, wherein the high-strength steel sheet has a microstructure including specific microstructures in a surface layer region extending from the surface of the steel sheet to a depth of 100 μm and in an inner region other than the surface layer region. The high-strength steel sheet has the maximum height of the surface roughness of 30 μm or less, a tensile strength of 980 MPa or more, a uniform elongation of 6% or more, and a ratio of $10^7$-cycle plane bending fatigue strength to tensile strength (fatigue limit ratio) of 0.45 or more.

8 Claims, 1 Drawing Sheet

(51) Int. Cl.

| | |
|---|---|
| ***C21D 6/00*** | (2006.01) |
| ***C21D 8/02*** | (2006.01) |
| ***C22C 38/00*** | (2006.01) |
| ***C22C 38/02*** | (2006.01) |
| ***C22C 38/04*** | (2006.01) |
| ***C22C 38/06*** | (2006.01) |
| ***C22C 38/08*** | (2006.01) |
| ***C22C 38/12*** | (2006.01) |
| ***C22C 38/14*** | (2006.01) |
| ***C22C 38/16*** | (2006.01) |
| ***C22C 38/28*** | (2006.01) |
| ***C22C 38/32*** | (2006.01) |
| ***C22C 38/38*** | (2006.01) |
| ***C22C 38/60*** | (2006.01) |

(52) U.S. Cl.

CPC ..... *C21D 6/008* (2013.01); *C21D 8/0205* (2013.01); *C21D 8/021* (2013.01); *C21D 8/0226* (2013.01); *C21D 8/0263* (2013.01); *C21D 8/0278* (2013.01); *C22C 38/001* (2013.01); *C22C 38/002* (2013.01); *C22C 38/005* (2013.01); *C22C 38/02* (2013.01); *C22C 38/04* (2013.01); *C22C 38/06* (2013.01); *C22C 38/08* (2013.01); *C22C 38/12* (2013.01); *C22C 38/14* (2013.01); *C22C 38/16* (2013.01); *C22C 38/28* (2013.01); *C22C 38/32* (2013.01); *C22C 38/38* (2013.01); *C22C 38/60* (2013.01); *C21D 2211/001* (2013.01); *C21D 2211/002* (2013.01); *C21D 2211/005* (2013.01); *C21D 2211/008* (2013.01)

(56) References Cited

U.S. PATENT DOCUMENTS

| | | | |
|---|---|---|---|
| 2017/0197235 | A1 | 7/2017 | Shuto et al. |
| 2020/0063227 | A1 | 2/2020 | Yamazaki et al. |

FOREIGN PATENT DOCUMENTS

| | | | |
|---|---|---|---|
| EP | 2 444 510 | A1 | 4/2012 |
| EP | 2 617 853 | A1 | 7/2013 |
| JP | 2002129286 | A | 5/2002 |
| JP | 2010-275627 | A | 12/2010 |
| JP | 2012012701 | A | 1/2012 |
| JP | 2016050335 | A | 4/2016 |
| WO | 2014188966 | A1 | 11/2014 |
| WO | 2016010004 | A1 | 1/2016 |
| WO | 2018150955 | A1 | 8/2018 |
| WO | 2020250735 | A1 | 12/2020 |

OTHER PUBLICATIONS

International Search Report and Written Opinion for International Application No. PCT/JP2022/011492, dated Jun. 7, 2022, 5 pages.

Office Action (The First Office Action) issued Jun. 6, 2025, by the State Intellectual Property Office of People's Republic of China in corresponding Chinese Patent Application No. 202280023928.4 and an English translation with Concise explanation of relevance of the Office Action. (11 pages).

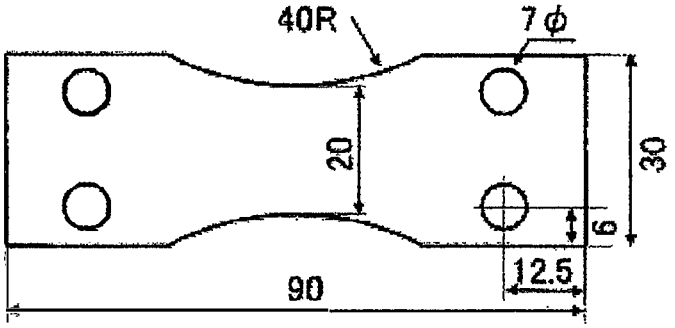
40R
7φ
20
30
6
12.5
90

HIGH-STRENGTH STEEL SHEET AND METHOD FOR MANUFACTURING THE SAME

CROSS REFERENCE TO RELATED APPLICATIONS

This is the U.S. National Phase application of PCT/JP2022/011492, filed Mar. 15, 2022, which claims priority to Japanese Patent Application No. 2021-062131, filed Mar. 31, 2021, the disclosures of these applications being incorporated herein by reference in their entireties for all purposes.

FIELD OF THE INVENTION

The present invention relates to a high-strength steel sheet and a method for manufacturing the high-strength steel sheet. In particular, aspects of the present invention relate to a high-strength steel sheet that has a tensile strength of 980 MPa or more, a uniform elongation of 6% or more, and high fatigue resistance, and that is suitable as a material for a frame, a suspension component, or the like of a truck or a passenger car, and a method for manufacturing the high-strength steel sheet.

BACKGROUND OF THE INVENTION

Against the background of automobile exhaust emission control aimed at global warming mitigation, there is a need for lighter vehicles. To reduce the vehicle weight, it is effective to reduce the amount of material used for an automotive part by increasing the strength and reducing the thickness of the material used for the automotive part. Thus, high-strength steel sheets have been increasingly used year by year. In particular, high-strength steel sheets with a tensile strength of 980 MPa or more are expected as materials that can dramatically improve the mileage of automobiles through weight reduction.

However, steel sheets with higher tensile strength have lower ductility and press formability. Automotive parts, particularly chassis parts, such as suspension components, need to have complex shapes to ensure rigidity. Thus, materials for automotive parts require high press formability or ductility.

Furthermore, the fatigue strength of steel sheets should be improved to ensure the durability of parts. However, steel sheets with higher tensile strength do not necessarily have higher fatigue strength. Low fatigue strength may result in parts with lower durability than assumed in the design. Thus, materials for automotive parts and the like require high fatigue resistance.

Techniques for improving the ductility and fatigue resistance of steel sheets while increasing the tensile strength of the steel sheets have been proposed, for example, in Patent Literature 1 to Patent Literature 3.

PATENT LITERATURE

PTL 1: International Publication No. WO 2016/010004

PTL 2: Japanese Unexamined Patent Application Publication No. 2012-012701

PTL 3: International Publication No. WO 2014/188966

SUMMARY OF THE INVENTION

However, the related art as described in Patent Literature 1 to Patent Literature 3 has problems as described below.

The techniques described in Patent Literature 1 and Patent Literature 2 cannot achieve a tensile strength of 980 MPa or more. Although it is argued in Patent Literature 1 and Patent Literature 2 that hot-rolled steel sheets have high workability, "elongation" is used as a measure of workability. This "elongation", which is also referred to as the total elongation (El), represents the elongation at the point in time when a test specimen breaks in a tensile test. In practice, however, necking (constriction) occurs before breakage. Necking locally reduces the thickness of the sheet and results in a defective product during press forming. Thus, high total elongation is not sufficient for high press formability.

According to the technique described in Patent Literature 3, although a high-strength steel sheet with good fatigue property is manufactured, the main phase is a tempered martensite or a lower bainite phase with poor ductility. Thus, the steel sheet has insufficient ductility and may cause a forming defect when the steel sheet is applied to a member requiring high ductility, such as an automotive chassis.

Thus, a technique for manufacturing a high-strength steel sheet with a high level of tensile strength, press formability, and fatigue resistance has not yet been established.

Aspects of the present invention have been made in view of such situations and aim to provide a high-strength steel sheet with a tensile strength of 980 MPa or more, high press formability, and high fatigue resistance, and a method for manufacturing the high-strength steel sheet.

To solve the above problems, the present inventors made hypothetical stress-strain curves of steel sheets with a tensile strength of 980 MPa or more and with various yield stresses and uniform elongations, and performed a press forming simulation of a suspension component using the stress-strain curves. The characteristics of a steel sheet required for high press formability were examined on the basis of the results of the simulation.

As a result, it was found that, having a uniform elongation of 6% or more, a steel sheet with a tensile strength of 980 MPa or more can have the minimum thickness reduction during press forming and is less likely to have press forming defects.

The present inventors have also studied an optimum steel sheet microstructure to achieve a tensile strength of 980 MPa or more and a uniform elongation of 6% or more. As a result, it was found that a microstructure that contains upper bainite as a main phase and contains an appropriate amount of hard second phase containing fresh martensite and/or retained austenite can achieve both a high strength of 980 MPa or more and a uniform elongation of 6% or more.

It was also found that Si, Mn, Cr, and Mo should be added in a well-balanced manner to form a microstructure containing an appropriate amount of hard second phase containing fresh martensite and/or retained austenite.

The term "upper bainite", as used herein, refers to an aggregate of lath ferrite with an orientation difference of less than 15 degrees and refers to a microstructure with Fe-based carbide and/or retained austenite between lath ferrites (including a microstructure without Fe-based carbide and/or retained austenite between lath ferrites). Unlike lamellar (layered) ferrite or polygonal ferrite in pearlite, lath ferrite has a lath shape and has a relatively high dislocation density inside, so that they can be distinguished with a scanning electron microscope (SEM) or a transmission electron microscope (TEM). In the presence of retained austenite between laths, only a lath ferrite portion is regarded as upper bainite and is distinguished from the retained austenite. The fresh martensite refers to martensite without Fe-based carbide. Fresh martensite and retained austenite have a similar contrast in SEM but can be distinguished by an electron backscatter diffraction patterns (EBSD) method.

In general, the fatigue life of a steel sheet depends on the time required for the formation of a fatigue crack and the time required for the growth of the fatigue crack, and a steel sheet with good fatigue property can be obtained by increasing these times. The present inventors have newly found that the maximum height (Ry) of the surface roughness of a high-strength steel sheet can be controlled to delay the formation of an initial crack and improve fatigue resistance. It was also found that the microstructure of a surface layer of a steel sheet can be controlled to delay the growth of an initial fatigue crack and further improve the fatigue resistance.

Aspects of the present invention have been made by further examination based on these findings and are as follows.

[1] A high-strength steel sheet which comprises:

a chemical composition containing, in mass %:

C: 0.05% to 0.20%,

Si: 0.6% to 1.2%,

Mn: 1.3% to 3.7%,

P: 0.10% or less,

S: 0.03% or less,

Al: 0.001% to 2.0%,

N: 0.01% or less,

O: 0.01% or less,

B: 0.0005% to 0.010%, the remainder being Fe and incidental impurities, and

MSC value defined by the following formula (1) in the range of 2.7% to 3.8% by mass;

a microstructure in a surface layer region extending from a surface of the steel sheet to a depth of 100 μm containing 70% by area or more of upper bainite and 2% by area or more of fresh martensite and/or retained austenite in total, the upper bainite having an average grain size of 7 μm or less, the fresh martensite and/or retained austenite having an average grain size of 4 μm or less, and the fresh martensite and/or retained austenite has a number density of 100/mm$^2$ or more; and a microstructure in an inner region other than the surface layer region containing 70% by area or more of upper bainite and 3% by area or more of fresh martensite and/or retained austenite in total, wherein the high-strength steel sheet has:

a maximum height of a surface roughness of 30 μm or less, and;

a tensile strength of 980 MPa or more, and a uniform elongation of 6% or more, and a ratio of $10^7$-cycle plane bending fatigue strength to tensile strength (fatigue limit ratio) of 0.45 or more, $$\text{MSC (\% by mass)} = \text{Mn} + 0.2\times\text{Si} + 1.7\times\text{Cr} + 2.5\times\text{Mo} \quad (1)$$

where each element symbol in the formula (1) denotes a corresponding element content (% by mass) and is 0 in the absence of the element.

[2] The high-strength steel sheet according to [1], wherein the chemical composition further contains, in mass %, at least one of Cr: 1.0% or less and Mo: 1.0% or less.

[3] The high-strength steel sheet according to [1] or [2], wherein the chemical composition further contains, in mass %, at least one of Cu: 2.0% or less, Ni: 2.0% or less, Ti: 0.3% or less, Nb: 0.3% or less, and V: 0.3% or less.

[4] The high-strength steel sheet according to any one of [1] to [3], wherein the chemical composition further contains, in mass %, Sb: 0.005% to 0.020%.

[5] The high-strength steel sheet according to any one of [1] to [4], wherein the chemical composition further contains, in mass %, at least one of Ca: 0.01% or less, Mg: 0.01% or less, and REM: 0.01% or less.

[6] A method for manufacturing the high-strength steel sheet according to any one of [1] to [5], which comprises:

heating a steel material having the chemical composition to a heating temperature of 1150° C. or more;

hot rolling including rough rolling and finish rolling the steel material after the heating into a hot-rolled steel sheet while performing descaling at least twice between start of the rough rolling and start of the finish rolling including performing the descaling with a water pressure of 15 MPa or more once or more within 5 seconds before the start of the finish rolling, the finish rolling being performed under conditions of a finishing temperature: (RC2−50° C.) or more and (RC2+120° C.) or less and a total rolling reduction of 25% or more and 80% or less at a temperature of RC1 or less;

cooling the hot-rolled steel sheet under conditions of a time from completion of the hot rolling to start of cooling: 2.0 seconds or less, an average cooling rate: 5° C./s or more, and a cooling stop temperature: Trs or more and (Trs+250° C.) or less;

coiling the hot-rolled steel sheet after the cooling at a coiling temperature: Trs or more and (Trs+250° C.) or less; and cooling the hot-rolled steel sheet to 100° C. or less with an average cooling rate of 20° C./s or less, wherein RC1, RC2, and Trs are represented by the following formulae (2), (3), and (4), respectively, $$\text{RC1}(^\circ\text{C.}) = 900 + 100\times\text{C} + 100\times\text{N} + 10\times\text{Mn} + 700\times\text{Ti} + 5000\times\text{B} + 10\times\text{Cr} + 50\times\text{Mo} + 2000\times\text{Nb} + 150\times\text{V} \quad (2)$$

$$\text{RC2}(^\circ\text{C.}) = 750 + 100\times\text{C} + 100\times\text{N} + 10\times\text{Mn} + 350\times\text{Ti} + 5000\times\text{B} + 10\times\text{Cr} + 50\times\text{Mo} + 1000\times\text{Nb} + 150\times\text{V} \quad (3)$$

$$\text{Trs}(^\circ\text{C.}) = 500 - 450\times\text{C} - 35\times\text{Mn} - 15\times\text{Cr} - 10\times\text{Ni} - 20\times\text{Mo} \quad (4)$$

where each element symbol in the formulae (2), (3), and (4) denotes a corresponding element content (% by mass) and is 0 in the absence of the element.

Aspects of the present invention can provide a high-strength steel sheet with a tensile strength of 980 MPa or more, high press formability, and high fatigue resistance. A high-strength steel sheet according to aspects of the present invention has high press formability in spite of high tensile strength and can be press-formed without a forming defect, such as necking or cracking. The application of a high-strength steel sheet according to aspects of the present invention to a member of a truck or a passenger car can reduce the amount of steel material used while ensuring safety, and reduce the weight of the automobile body, thus contributing to reducing the effects on the environment.

The phrase "high press formability", as used herein, refers to a uniform elongation of 6% or more. The phrase "high fatigue resistance", as used herein, refers to a ratio of $10^7$-cycle plane bending fatigue strength to tensile strength (fatigue limit ratio) of 0.45 or more in a completely reversed plane bending fatigue test.

BRIEF DESCRIPTION OF THE DRAWING

The FIGURE is a schematic view of the shape of a test specimen for a plane bending fatigue test in Example.

DETAILED DESCRIPTION OF EMBODIMENTS OF THE INVENTION

Embodiments of the present invention are specifically described below. The following description shows an example of a preferred embodiment of the present invention, and the present invention is not limited to this.

[Chemical Composition]

First, the reasons for limiting the chemical composition of a high-strength steel sheet according to aspects of the present invention are described below. Unless otherwise specified, "%" as a unit of the content refers to "% by mass".

C: 0.05% to 0.20%

C is an element with the effect of improving the strength of steel. C improves hardenability, thereby promotes the formation of bainite, and contributes to improve the strength. C increases the strength of martensite and also contributes to improve the strength. To achieve a tensile strength of 980 MPa or more, the C content should be 0.05% or more. Thus, the C content is 0.05% or more, preferably 0.06% or more. On the other hand, a C content of more than 0.20% results in martensite with excessively increased strength, a larger difference in strength between upper bainite serving as a main phase and fresh martensite and/or retained austenite, and consequently lower uniform elongation. Thus, the C content is 0.20% or less, preferably 0.18% or less.

Si: 0.6% to 1.2%

Si has the effect of reducing the formation of Fe-based carbide and reduces the precipitation of cementite during upper bainite transformation. This distributes C to non-transformed austenite, and cooling after coiling in a hot-rolling process transforms the non-transformed austenite into fresh martensite and/or retained austenite, thereby forming the desired fresh martensite and/or retained austenite. These effects require a Si content of 0.6% or more, preferably 0.7% or more. On the other hand, Si is an element that forms a subscale on the surface of a steel sheet during hot rolling. A Si content of more than 1.2% results in an excessively thick subscale, a steel sheet with excessively large surface roughness after descaling, and a high-strength steel sheet with poorer coating pretreatment property and fatigue property. Thus, the Si content is 1.2% or less, preferably 1.1% or less.

Mn: 1.3% to 3.7%

Mn stabilizes austenite and contributes to the formation of fresh martensite and/or retained austenite. Such effects require a Mn content of 1.3% or more. Thus, the Mn content is 1.3% or more, preferably 1.4% or more. On the other hand, a Mn content of more than 3.7% results in excessive formation of fresh martensite and/or retained austenite, and lower uniform elongation. Thus, the Mn content is 3.7% or less, preferably 3.6% or less, more preferably 3.5% or less.

P: 0.10% or Less

P is an element that contributes to an increase in the strength of steel through solid solution. However, P is also an element that segregates at an austenite grain boundary during hot rolling and thereby causes slab cracking during the hot rolling. P also segregates at a grain boundary and reduces the uniform elongation. Thus, the P content is preferably minimized and may be 0.10% or less. Thus, the P content is 0.10% or less. Although the lower limit is not particularly limited, the P content is preferably 0.0002% or more because a P content of less than 0.0002% causes a decrease in production efficiency.

S: 0.03% or Less

S binds to Ti or Mn and forms a coarse sulfide, which accelerates the formation of a void and reduces the uniform elongation. Thus, the S content is preferably minimized and may be 0.03% or less. Thus, the S content is 0.03% or less. Although the lower limit is not particularly limited, the S content is preferably 0.0002% or more because a S content of less than 0.0002% causes a decrease in production efficiency.

Al: 0.001% to 2.0%

Al is an element that acts as a deoxidizing agent and is effective in improving the cleanliness of steel. This effect is insufficient at an Al content of less than 0.001%. Thus, the Al content is 0.001% or more, preferably 0.005% or more, more preferably 0.010% or more. Like Si, Al is effective in reducing the formation of Fe-based carbide and reduces the precipitation of cementite during upper bainite transformation. This contributes to the formation of fresh martensite and/or retained austenite during cooling after coiling. On the other hand, an excessively high Al content results in an increased number of oxide inclusions and lower uniform elongation. Thus, the Al content is 2.0% or less, preferably 1.0% or less, more preferably 0.1% or less.

N: 0.01% or Less

N binds to a nitride-forming element, thereby precipitates as a nitride, and generally contributes to grain refinement. However, N binds to Ti at high temperatures and forms a coarse nitride. Thus, a N content of more than 0.01% results in lower uniform elongation. Thus, the N content is 0.01% or less. Although the lower limit is not particularly limited, the N content is preferably 0.0002% or more because a N content of less than 0.0002% causes a decrease in production efficiency.

O: 0.01% or Less

O generates an oxide and reduces formability. Thus, the O content should be reduced. In particular, this tendency is remarkable at an O content of more than 0.01%. Thus, the O content is 0.01% or less, preferably 0.005%, more preferably 0.003%. Although the lower limit is not particularly specified, the O content is preferably 0.00005% or more because the production efficiency may be significantly lowered at an O content of less than 0.00005%.

B: 0.0005% to 0.010%

B is an element that segregates in a prior-austenite grain boundary, reduces the formation of ferrite, thereby promotes the formation of upper bainite, and contributes to improving the strength of a steel sheet. These effects require a B content of 0.0005% or more. Thus, the B content is 0.0005% or more, preferably 0.0006% or more, more preferably 0.0007% or more. On the other hand, these effects are saturated at a B content of more than 0.010%. Thus, the B content is 0.010% or less, preferably 0.009% or less, more preferably 0.008% or less.

The remainder is composed of Fe and incidental impurities. Examples of the incidental impurities include Zr, Co, Sn, Zn, and W. When the chemical composition contains at least one of Zr, Co, Sn, Zn, and W as incidental impurities, the total amount of the element(s) is preferably 0.5% or less.

The chemical composition of a high-strength steel sheet according to aspects of the present invention may optionally contain at least one of the following elements.

Cr: 1.0% or Less

Cr is a carbide-forming element and has the effect of reducing driving force for bainite transformation by segregating at an interface between upper bainite and non-transformed austenite during upper bainite transformation before coiling, thereby stopping the upper bainite transformation. Non-transformed austenite remained due to the stopped upper bainite transformation becomes fresh martensite and/or retained austenite by cooling after coiling. Thus, Cr, if added, also contributes to the formation of a desired area ratio of fresh martensite and/or retained austenite. This effect is preferably produced at a Cr content of 0.1% or more. However, a Cr content of more than 1.0% results in excessive formation of fresh martensite and/or retained austenite and lower uniform elongation. Thus, when Cr is added, the Cr content is 1.0% or less, preferably 0.9% or less, more preferably 0.8% or less.

Mo: 1.0% or Less

Mo promotes the formation of bainite through the improvement of hardenability and contributes to improving the strength of a steel sheet. Like Cr, Mo is a carbide-forming element, segregates at an interface between upper bainite and non-transformed austenite during upper bainite transformation before coiling, thereby reduces transformation driving force for bainite, and contributes to the formation of fresh martensite and/or retained austenite after coiling and cooling. This effect is preferably produced at a Mo content of 0.1% or more. However, a Mo content of more than 1.0% results in excessive formation of fresh martensite and/or retained austenite and lower uniform elongation. Thus, when Mo is added, the Mo content is 1.0% or less, preferably 0.9% or less, more preferably 0.8% or less.

The chemical composition of a high-strength steel sheet according to aspects of the present invention may also optionally contain at least one of the following elements.

Cu: 2.0% or Less

Cu is an element that contributes to an increase in the strength of steel through solid solution. Cu promotes the formation of bainite through the improvement of hardenability and contributes to improving the strength. This effect is preferably produced at a Cu content of 0.01% or more. However, a Cu content of more than 2.0% results in a high-strength steel sheet with lower surface quality and fatigue property. Thus, when Cu is added, the Cu content is 2.0% or less, preferably 1.9% or less, more preferably 1.8% or less.

Ni: 2.0% or Less

Ni is an element that contributes to an increase in the strength of steel through solid solution. Ni promotes the formation of bainite through the improvement of hardenability and contributes to improving the strength. This effect is preferably produced at a Ni content of 0.01% or more. However, a Ni content of more than 2.0% results in an excessive increase of fresh martensite and/or retained austenite and a high-strength steel sheet with lower ductility. Thus, when Ni is added, the Ni content is 2.0% or less, preferably 1.9% or less, more preferably 1.8% or less.

Ti: 0.3% or Less

Ti is an element with the effect of improving the strength of a steel sheet by precipitation strengthening or solid-solution strengthening. Ti forms a nitride in a high-temperature region of austenite. This reduces the precipitation of BN and results in B in a solid solution state. Thus, Ti, if added, also contributes to ensuring hardenability necessary for the formation of upper bainite and improves the strength. This effect is preferably produced at a Ti content of 0.01% or more. However, a Ti content of more than 0.3% results in a large amount of Ti nitride and lower uniform elongation. Thus, when Ti is added, the Ti content is 0.3% or less, preferably 0.28% or less, more preferably 0.25% or less.

Nb: 0.3% or Less

Nb is an element with the effect of improving the strength of a steel sheet by precipitation strengthening or solid-solution strengthening. Like Ti, Nb increases the recrystallization temperature of austenite during hot rolling, thereby enables rolling in an austenite non-recrystallization temperature range, and contributes to decreasing the grain size of upper bainite and increasing the area ratio of fresh martensite and/or retained austenite. Like Cr, Nb is a carbide-forming element and is an element that segregates at an interface between upper bainite and non-transformed austenite during upper bainite transformation before coiling and thereby has the effect of reducing transformation driving force for bainite and stopping the upper bainite transformation while leaving the non-transformed austenite. The non-transformed austenite becomes fresh martensite and/or retained austenite by cooling thereafter. Thus, Nb, if added, also contributes to the formation of a desired area ratio of fresh martensite and/or retained austenite. This effect is preferably produced at a Nb content of 0.01% or more. However, a Nb content of more than 0.3% results in an excessive increase in fresh martensite and/or retained austenite and lower uniform elongation. Thus, when Nb is added, the Nb content is 0.3% or less, preferably 0.28% or less, more preferably 0.25% or less.

V: 0.3% or Less

V is an element with the effect of improving the strength of a steel sheet by precipitation strengthening and solid-solution strengthening. Like Ti, V increases the recrystallization temperature of austenite during hot rolling, thereby enables rolling in an austenite non-recrystallization temperature range, and contributes to decreasing the grain size of upper bainite. Like Cr, V is a carbide-forming element and is an element that segregates at an interface between upper bainite and non-transformed austenite during upper bainite transformation before coiling and thereby has the effect of reducing transformation driving force for bainite and stopping the upper bainite transformation while leaving the non-transformed austenite. The non-transformed austenite becomes fresh martensite and/or retained austenite by cooling thereafter. Thus, V, if added, also contributes to the formation of a desired area ratio of fresh martensite and/or retained austenite. This effect is preferably produced at a V content of 0.01% or more. However, a V content of more than 0.3% results in an excessive increase in fresh martensite and/or retained austenite and lower uniform elongation. Thus, when V is added, the V content is 0.3% or less, preferably 0.28% or less, more preferably 0.25% or less.

The chemical composition of a high-strength steel sheet according to aspects of the present invention may further optionally contain the following elements.

Sb: 0.005% to 0.020%

Sb is an element with the effect of reducing nitriding of the surface of a steel material (slab) when the steel material is heated. The addition of Sb can reduce the precipitation of BN in a surface layer portion of a steel material. As a result, remaining solid solution B contributes to ensuring hardenability necessary for the formation of bainite and thereby improving the strength of a steel sheet. When Sb is added, the Sb content is 0.005% or more, preferably 0.006% or more, more preferably 0.007% or more, to produce the effects. On the other hand, an Sb content of more than 0.020% results in steel with lower toughness and may cause slab cracking and hot-rolling cracking. Thus, when Sb is added, the Sb content is 0.020% or less, preferably 0.019% or less, more preferably 0.018% or less.

The chemical composition of a high-strength steel sheet according to aspects of the present invention may further optionally contain at least one of the following elements. The following elements contribute to further improvement of press formability or other characteristics.

Ca: 0.01% or Less

Ca controls the shape of an oxide or sulfide inclusion and contributes to reducing cracking of a sheared end face of a steel sheet and further improving the bendability of a steel sheet. This effect is preferably produced at a Ca content of 0.001% or more. However, a Ca content of more than 0.01% may result in an increase of a Ca-based inclusion and steel with lower cleanliness and rather result in sheared end face cracking or bending cracking. Thus, when Ca is added, the Ca content is 0.01% or less.

Mg: 0.01% or Less

Like Ca, Mg controls the shape of an oxide or sulfide inclusion and contributes to reducing cracking of a sheared end face of a steel sheet and further improving the bendability of a steel sheet. This effect is preferably produced at a Mg content of 0.001% or more. However, a Mg content of more than 0.01% may result in steel with lower cleanliness and rather result in sheared end face cracking or bending cracking. Thus, when Mg is added, the Mg content is 0.01% or less.

REM: 0.01% or Less

Like Ca, a rare-earth metal (REM) controls the shape of an oxide or sulfide inclusion and contributes to reducing cracking of a sheared end face of a steel sheet and further improving the bendability of a steel sheet. This effect is preferably produced at a REM content of 0.001% or more. However, a REM content of more than 0.01% may result in steel with lower cleanliness and rather result in sheared end face cracking or bending cracking. Thus, when REM is added, the REM content is 0.01% or less.

In accordance with aspects of the present invention, MSC value defined by the following formula (1) ranges from 2.7% to 3.8% by mass. To achieve high uniform elongation while maintaining a tensile strength of 980 MPa or more, the area ratio of fresh martensite and/or retained austenite should be controlled in an appropriate range, as described later. To control the area ratio of fresh martensite and/or retained austenite, the addition balance of Mn, Si, Cr (if added), and Mo (if added) is important and, more specifically, the MSC value defined by the following formula (1) should range from 2.7% to 3.8% by mass. In a high-strength steel sheet with a tensile strength of 980 MPa or more, a uniform elongation of 6% or more cannot be achieved at an MSC value outside the above range. The MSC value is preferably 2.75% by mass or more, more preferably 2.80% by mass or more. The MSC value is preferably 3.75% by mass or less, more preferably 3.70% by mass or less.

$$\text{MSC (\% by mass)} = \text{Mn} + 0.2\times\text{Si} + 1.7\times\text{Cr} + 2.5\times\text{Mo} \quad (1)$$

Each element symbol in the formula (1) denotes a corresponding element content (% by mass) and is 0 in the absence of the element.

[Microstructure]

Next, the reasons for limiting the microstructure of a high-strength steel sheet according to aspects of the present invention are described below.

A high-strength steel sheet according to aspects of the present invention has a microstructure containing 70% by area or more of upper bainite and 2% by area or more of fresh martensite and/or retained austenite in total in a surface layer region extending from a surface of the steel sheet to a depth of 100 μm. The upper bainite has an average grain size of 7 μm or less, the fresh martensite and/or retained austenite has an average grain size of 4 μm or less, and the fresh martensite and/or retained austenite has a number density of $100/mm^2$ or more. An inner region other than the surface layer region contains 70% by area or more of upper bainite and 3% by area or more of fresh martensite and/or retained austenite in total.

First, the microstructure of the surface layer region extending from the surface of the steel sheet to a depth of 100 μm is described below.

Upper Bainite: 70% or More

The microstructure of a high-strength steel sheet according to aspects of the present invention contains upper bainite as a main phase. When the upper bainite has an area ratio of less than 70%, a tensile strength of 980 MPa or more and a uniform elongation of 6% or more cannot be achieved. Thus, the upper bainite has an area ratio of 70% or more, preferably 80% or more.

Fresh Martensite and/or Retained Austenite: 2% by Area or More in Total

To improve the fatigue property, the fresh martensite and/or retained austenite has a total area ratio of 2% or more, preferably 3% or more. On the other hand, when the fresh martensite and/or retained austenite has a total area ratio of 30% or more, this may result in an increase in the interface between the fresh martensite and/or retained austenite and bainite, which can be a fatigue crack initiation point, and result in poorer fatigue property. Thus, the fresh martensite and/or retained austenite preferably has a total area ratio of 30% or less, more preferably 25% or less, still more preferably 20% or less.

In the surface layer region extending from the surface of the steel sheet to a depth of 100 μm, due to a high cooling rate, bainite transformation proceeds rapidly, and carbon concentrating for forming fresh martensite and/or retained austenite is lower than that in the inside of the steel sheet. Consequently, the fresh martensite and/or retained austenite in the surface layer region extending from the surface to the depth of 100 μm of the steel sheet has a smaller area ratio than in the inside of the steel sheet, and the difference thereof is approximately 1%.

The Average Grain Size of Upper Bainite: 7 μm or Less, and the Average Grain Size of Fresh Martensite and/or Retained Austenite: 4 μm or Less It is said that a fatigue crack is initiated by a slip in a crystal grain in a surface layer. A crystal grain boundary makes it difficult for the slip to propagate to an adjacent crystal grain and consequently delays crack initiation. Thus, grain refinement can improve the fatigue strength. To produce this effect, the upper bainite should have an average grain size of 7 μm or less, preferably 6 μm or less. The fresh martensite and/or retained austenite has an average grain size of 4 μm or less, preferably 3 μm or less. A smaller average grain size is more effective in delaying fatigue crack initiation. However, an excessively small average grain size may result in higher strength and lower elongation. Thus, the upper bainite preferably has an average grain size of 2 μm or more. The fresh martensite and/or retained austenite preferably has an average grain size of 0.5 μm or more.

Number Density of Fresh Martensite and/or Retained Austenite: 100/Mm$^2$ or More A fatigue crack is mostly initiated from the surface of a steel sheet, grows to tens of micrometers in length, and then enters a fatigue crack propagation stage. In high-cycle fatigue, the number of cycles before entering the crack propagation stage occupies most of the fatigue life. Thus, it is important to control the microstructure of a surface layer extending to a depth of 100 μm to improve $10^7$-cycle fatigue strength. In a high-strength steel sheet according to aspects of the present invention, the number density is 100/mm$^2$ or more, preferably 200/mm$^2$ or more, to finely disperse hard fresh martensite and/or retained austenite in soft upper bainite, thereby preventing rearrangement of dislocations increased during repeated loading, delaying repeated softening, and improving the fatigue property.

Next, the microstructure of the inner region other than the surface layer region is described below.

Upper Bainite: 70% or More

The microstructure of a high-strength steel sheet according to aspects of the present invention contains upper bainite as a main phase in the inner region as in the surface layer region. When the upper bainite has an area ratio of less than 70%, a tensile strength of 980 MPa or more and a uniform elongation of 6% or more cannot be achieved. Thus, the upper bainite has an area ratio of 70% or more, preferably 80% or more.

Fresh Martensite and/or Retained Austenite: 3% by Area or More in Total

The microstructure of a high-strength steel sheet according to aspects of the present invention contains fresh martensite and/or retained austenite. Fresh martensite has the effect of promoting work hardening, delaying the onset of plastic instability, and thereby improving the uniform elongation. Retained austenite can improve the uniform elongation by the transformation induced plasticity (TRIP) effect. To produce these effects, the area ratio of fresh martensite and/or retained austenite is 3% or more, preferably 4% or more. On the other hand, when the fresh martensite and/or retained austenite has a total area ratio of 30% or more, this may result in an increase in the interface between the fresh martensite and/or retained austenite and bainite, which can be a fatigue crack initiation point, and result in poorer fatigue property. Thus, the fresh martensite and/or retained austenite preferably has an area ratio of 30% or less, more preferably 25% or less, more preferably 20% or less.

The microstructure may further contain a microstructure other than upper bainite, fresh martensite, and retained austenite (hereinafter referred to as "another microstructure"). From the perspective of enhancing the effect of microstructure control, another microstructure preferably has a total area ratio of 3% or less. In other words, the upper bainite, fresh martensite, and retained austenite in the microstructure preferably have a total area ratio of 97% or more. Examples of the other microstructure include cementite, polygonal ferrite, pearlite, tempered martensite, and lower bainite.

Maximum Height (Ry) of Surface Roughness of Steel Sheet: 30 μm or Less

A steel sheet with a large maximum height (Ry) of the surface roughness has local stress concentration in a recessed portion of a surface layer in a plane bending fatigue test, early fatigue crack initiation, and poor fatigue property. Thus, to provide a high-strength steel sheet with good fatigue property, the maximum height (Ry) of the surface roughness of a steel sheet is 30 μm or less. The fatigue property is improved as the maximum height (Ry) of the surface roughness of a steel sheet decreases. Thus, the maximum height (Ry) of the surface roughness of a steel sheet is preferably 25 μm or less, more preferably 20 μm or less.

[Mechanical Properties]

A high-strength steel sheet according to aspects of the present invention has a tensile strength of 980 MPa or more, a uniform elongation of 6% or more, and a fatigue limit ratio of 0.45 or more (the ratio of $10^7$-cycle plane bending fatigue strength to tensile strength). Thus, despite its high tensile strength, a high-strength steel sheet according to aspects of the present invention has high press formability, can be press-formed without a forming defect, such as necking or cracking, and can ensure safety when applied to a member of a truck or a passenger car.

The microstructure, surface roughness, and mechanical properties in accordance with aspects of the present invention can be determined by measurement methods described below in Examples.

[Manufacturing Method]

Next, a method for manufacturing a high-strength steel sheet according to an embodiment of the present invention is described. Unless otherwise specified, the temperature in the following description represents the surface temperature of an object (a steel material or a steel sheet).

A high-strength steel sheet according to aspects of the present invention can be manufactured by sequentially subjecting a steel material to the following treatments (1) to (5). Each of the steps is described below.

(1) Heating
(2) Hot rolling
(3) Cooling (first cooling)
(4) Coiling
(5) Cooling (second cooling)

The steel material may be any material with the chemical composition described above. The chemical composition of the final high-strength steel sheet is the same as the chemical composition of the steel material used. The steel material can be a steel slab, for example. The steel material may be manufactured by any method. For example, a molten steel with the chemical composition described above can be obtained by steelmaking by a known method using a converter or the like, and a steel material can be manufactured by a casting method, such as continuous casting. It is also possible to use a method other than the continuous casting method, such as an ingot casting and blooming method. Scrap may also be used as a raw material. The steel material manufactured by the continuous casting method or the like may be directly subjected to the next heating step or may be cooled and subjected as a hot piece or a cold piece to the heating step.

(1) Heating

First, the steel material is heated to a heating temperature of 1150° C. or more. In general, carbonitride-forming elements, such as Ti, are mostly present as coarse carbonitrides in steel materials. The presence of the coarse and nonuniform precipitates causes degradation of various characteristics generally required for high-strength steel sheets for truck and passenger car components (for example, sheared edge cracking resistance, bendability, burring formability, and the like). Thus, the steel material should be heated before hot rolling to dissolve coarse precipitates. More specifically, the heating temperature of the steel material should be 1150° C. or more to sufficiently dissolve coarse precipitates. On the other hand, an excessively high heating temperature of the steel material results in the occurrence of a slab defect and a decrease in yield due to scaling off. Thus, from the perspective of improving the yield, the heating temperature of the steel material is preferably 1350° C. or less. The lower limit of the heating temperature of the steel material is more preferably 1180° C. or more, still more preferably 1200° C. or more. The upper limit of the heating temperature of the steel material is more preferably 1300° C. or less, still more preferably 1280° C. or less.

In the heating, from the perspective of uniformizing the temperature of the steel material, the temperature of the steel material is preferably increased to the heating temperature and is then maintained at the heating temperature. The holding time at the heating temperature is preferably, but not limited to, 1800 seconds or more from the perspective of improving the temperature uniformity of the steel material. On the other hand, a holding time of more than 10,000 seconds results in an increased amount of scales. This often causes scale biting or the like in the subsequent hot rolling and decreases the yield due to defective surface flaws. Thus, the holding time is preferably 10,000 seconds or less, more preferably 8000 seconds or less.

(2) Hot Rolling

The heated steel material is then hot-rolled to form a hot-rolled steel sheet. The hot rolling may include rough rolling and finish rolling. Although the rough rolling may be performed under any conditions, the surface scale should be removed between the start of the rough rolling and the start of the finish rolling to reduce the surface roughness of the steel sheet.

In accordance with aspects of the present invention, descaling is performed at least twice between the start of the rough rolling and the start of the finish rolling, and descaling at a water pressure of 15 MPa or more is performed once or more within 5 seconds before the start of the finish rolling. The temperature of the steel sheet is high during the rough rolling or before the finish rolling, and a thick surface scale tends to be formed. To remove such a surface scale, descaling is performed at least twice, preferably three times or more. Furthermore, descaling within 5 seconds before the start of the finish rolling has a large effect of reducing the surface roughness. Thus, to control the maximum height (Ry) of the surface roughness of the steel sheet to 30 μm or less, in addition to descaling performed at least twice, the water pressure of descaling should be increased to 15 MPa or more within 5 seconds before the start of the finish rolling. When the water pressure of the descaling is less than 15 MPa, scales remain on the surface of the steel sheet before the finish rolling and increase the roughness of the surface of the steel sheet after the finish rolling, so that the maximum height of the surface roughness of the steel sheet exceeds 30 μm. Thus, the water pressure of the descaling within 5 seconds before the start of the finish rolling is 15 MPa or more, preferably 30 MPa or more, more preferably 60 MPa or more.

The water pressure of descaling other than the descaling performed within 5 seconds before the start of the finish rolling may be 10 MPa or more.

Next, in accordance with aspects of the present invention, in the finish rolling, when the temperature RC1 and the temperature RC2 are defined by the following formulae (2) and (3), the total rolling reduction at a temperature of RC1 or less is 25% or more and 80% or less, and the finishing temperature is (RC2−50° C.) or more and (RC2+120° C.) or less.

RC1 denotes the austenite 50% recrystallization temperature estimated from the chemical composition, and RC2 denotes the austenite recrystallization lower limit temperature estimated from the chemical composition. When the total rolling reduction at RC1 or less is less than 25%, the average grain size increases, and the effect of improving the fatigue property cannot be produced. On the other hand, when the total rolling reduction at a temperature of RC1 or less is more than 80%, austenite has a high dislocation density, a bainite microstructure transformed from the austenite with a high dislocation density has low ductility, and the uniform elongation of 6% or more cannot be achieved. Thus, the total rolling reduction at a temperature of RC1 or less is 25% or more and 80% or less.

The hot rolling is performed under the condition of finishing temperature: (RC2−50° C.) or more and (RC2+120° C.) or less. At a finishing temperature below (RC2−50° C.), bainite transformation occurs from austenite with a high dislocation density. Upper bainite transformed from austenite with a high dislocation density has a high dislocation density and low ductility, resulting in a decrease in the uniform elongation. The uniform elongation also decreases when the finish rolling temperature is low and the rolling is performed at a two-phase temperature of ferrite+austenite. Thus, the finishing temperature is (RC2−50° C.) or more. On the other hand, at a finishing temperature above (RC2+120° C.), austenite grains coarsen, and the average grain size of upper bainite increases, resulting in a decrease in the strength. Furthermore, fresh martensite and/or retained austenite also coarsens, and the uniform elongation decreases. Thus, the finishing temperature is (RC2+120° C.) or less. RC1 and RC2 are defined by the following formulae (2) and (3):

$$RC1(^\circ C.)=900+100\times C+100\times N+10\times Mn+700\times Ti+5000\times B+10\times Cr+50\times Mo+2000\times Nb+150\times V \quad (2)$$

$$RC2(^\circ C.)=750+100\times C+100\times N+10\times Mn+350\times Ti+5000\times B+10\times Cr+50\times Mo+1000\times Nb+150\times V \quad (3)$$

wherein each element symbol in the formulae (2) and (3) denotes a corresponding element content (% by mass) and is 0 in the absence of the element.

(3) Cooling (First Cooling)

Next, the hot-rolled steel sheet thus manufactured is cooled (first cooling). The time from completion of the hot rolling (completion of the finish rolling) to the start of the cooling (cooling start time) is 2.0 seconds or less. A cooling start time of more than 2.0 seconds results in the growth of austenite grains, thus failing to achieve a tensile strength of 980 MPa or more. The cooling start time is preferably 1.5 seconds or less.

The average cooling rate is 5° C./s or more. In accordance with aspects of the present invention, the surface layer is cooled more rapidly than the inside to form a microstructure that differs between the surface layer and the inside. The rapid cooling of the surface layer advances the bainite transformation start in the surface layer and forms a smaller amount of martensite and retained austenite due to carbon concentrating in the surface layer than in the inside. When the average cooling rate of the cooling is less than 5° C./s, the surface layer is not sufficiently rapidly cooled, and the surface layer microstructure containing 70% by area or more of upper bainite and 2% by area or more of fresh martensite and/or retained austenite in total cannot be formed. Thus, the average cooling rate is 5° C./s or more, preferably 20° C./s or more, more preferably 50° C./s or more. On the other hand, although the average cooling rate may have any upper limit, an excessively high average cooling rate makes it difficult to control the cooling stop temperature. Thus, the average cooling rate is preferably 200° C./s or less. The average cooling rate is specified on the basis of the average cooling rate at the surface of the steel sheet.

In the cooling, forced cooling may be performed at the average cooling rate. The cooling method is preferably, but not limited to, water cooling, for example.

The cooling stop temperature is Trs or more and (Trs+250° C.) or less. At a cooling stop temperature below Trs, the microstructure becomes tempered martensite or lower bainite. Both tempered martensite and lower bainite have a high-strength microstructure but have significantly low uniform elongation. Thus, the cooling stop temperature is Trs or more. On the other hand, at a cooling stop temperature above (Trs+250° C.), ferrite is formed, and the tensile strength of 980 MPa cannot be achieved. Thus, the cooling stop temperature is (Trs+250° C.) or less.

Trs is defined by the formula (4):

$$Trs(^\circ C.)=500-450\times C-35\times Mn-15\times Cr-10\times Ni-20\times Mo \quad (4)$$

wherein each element symbol in the formula (4) denotes a corresponding element content (% by mass) and is 0 in the absence of the element.

(4) Coiling

Next, the hot-rolled steel sheet after the cooling is coiled under the condition of a coiling temperature: Trs or more and (Trs+250° C.) or less. When the coiling temperature is below Trs, martensite transformation or lower bainite transformation proceeds after the coiling, and the desired fresh martensite and/or retained austenite cannot be formed. Thus, the coiling temperature is Trs or more. On the other hand, at a coiling temperature above (Trs+250° C.), ferrite is formed, and the tensile strength of 980 MPa cannot be achieved. Thus, the coiling temperature is (Trs+250° C.) or less.

(5) Cooling (Second Cooling)

After the coiling, cooling to 100° C. or less is further performed at an average cooling rate of 20° C./s or less (second cooling). The average cooling rate has an influence on the formation of fresh martensite and/or retained austenite. At an average cooling rate of more than 20° C./s, most of the non-transformed austenite undergoes martensite transformation, the desired retained austenite cannot be formed, and the uniform elongation decreases. Thus, the average cooling rate is 20° C./s or less, preferably 10° C./s or less, more preferably 1° C./s or less. On the other hand, the lower limit of the average cooling rate is preferably, but not limited to, 0.0001° C./s or more.

The cooling can be performed to any temperature of 100° C. or less, preferably in the range of approximately 10° C. to 30° C. (for example, room temperature). The cooling may be performed in any form, for example, in the state of a coil.

A high-strength steel sheet according to aspects of the present invention can be manufactured in accordance with the procedure described above. The coiling and the subsequent cooling may be followed by routine procedures. For example, temper rolling may be performed, or pickling may be performed to remove scales formed on the surface.

EXAMPLES

A molten steel with the composition shown in Table 1 was obtained by steelmaking in a converter, and a steel slab as a steel material was manufactured by a continuous casting method. The steel material was heated to the heating temperature shown in Table 2, and the steel material after the heating was then subjected to hot rolling including rough rolling and finish rolling to manufacture a hot-rolled steel sheet. The finishing temperature in the hot rolling was shown in Table 2. The water pressure of one of descaling operations performed twice or more was shown in Table 2, and the water pressure of the other descaling operations was 10 MPa.

Next, the hot-rolled steel sheet was cooled under the conditions of the average cooling rate and the cooling stop temperature shown in Table 2 (first cooling). The hot-rolled steel sheet after the cooling was coiled at the coiling temperature shown in Table 2, and the coiled steel sheet was cooled at the average cooling rate shown in Table 2 (second cooling) to manufacture a high-strength steel sheet. The cooling was followed by skin pass rolling and pickling as post-treatment. The pickling was performed at a temperature of 85° C. using aqueous hydrochloric acid with a concentration of 10% by mass.

A test specimen was taken from the high-strength steel sheet, and the microstructure, surface roughness, and mechanical properties were evaluated in accordance with the following procedures.

(Microstructure)

A test specimen for microstructure observation was taken from the high-strength steel sheet such that a thickness cross section parallel to the rolling direction was an observation surface. The surface of the test specimen was polished and was corroded with a corrosive liquid (3% by volume nital solution) to expose the microstructure.

The surface layer extending from a surface to a depth of 100 μm and the inner region other than the surface layer were then photographed with a scanning electron microscope (SEM) at a magnification of 5000 times in 10 visual fields to acquire a SEM image of the microstructure. The SEM image was analyzed by image processing to quantify the area ratios of upper bainite (UB), polygonal ferrite (F), and tempered martensite (TM). Fresh martensite (M) and retained austenite (γ) were difficult to distinguish with the SEM and were therefore identified by an electron backscatter diffraction patterns (EBSD) method, and the area ratio and the average grain size of each were determined. Table 3 shows the area ratio of each microstructure and the average grain size of the surface layer microstructure thus measured. Table 3 also shows the total area ratio (M+γ) of fresh martensite and retained austenite.

(Surface Roughness)

A test specimen for measuring the surface roughness of the steel sheet (size: t (thickness)×50 mm (width)×50 mm (length)) was taken from the high-strength steel sheet at five different width positions to measure the maximum height (Ry) of the surface roughness in accordance with JIS B 0601. The maximum height Ry of each test specimen taken at five different width positions was measured three times in the direction perpendicular to the rolling direction, and the average value was calculated as the maximum height Ry of the test specimen. The maximum height Ry of the high-strength steel sheet was evaluated by the average value of five test specimens taken at five different width positions.

(Tensile Test)

A JIS No. 5 test specimen (gauge length (GL): 50 mm) was taken from the high-strength steel sheet such that the tensile direction was perpendicular to the rolling direction. The test specimen was subjected to a tensile test in accordance with JIS Z 2241 to determine the yield strength (yield point, YP), tensile strength (TS), yield ratio (YR), total elongation (El), and uniform elongation (u-El). The tensile test of each high-strength steel sheet was performed twice, and the average of the measured values is shown in Table 3 as the mechanical characteristics of the high-strength steel sheet. In accordance with aspects of the present invention, a TS of 980 MPa or more was rated as high strength. A uniform elongation of 6% or more was rated as high press formability.

(Plane Bending Fatigue Test)

A test specimen with the size and shape shown in the FIGURE was taken from the high-strength steel sheet such that the longitudinal direction of the test specimen was perpendicular to the rolling direction, and was subjected to a plane bending fatigue test in accordance with JIS Z 2275. The stress loading mode was a stress ratio R=−1 and a frequency f=25 Hz. The applied stress amplitude was changed in six steps to measure the stress cycle until breakage and obtain an S—N curve, thereby determining the fatigue strength (fatigue limit) at $10^7$ cycles. In accordance with aspects of the present invention, when the value obtained by dividing the fatigue limit by the tensile strength (TS) determined in the tensile test is 0.45 or more, the fatigue property are rated as good.

TABLE 1

| Type of steel | Chemical composition (% by mass) * | | | | | | | | | |
|---|---|---|---|---|---|---|---|---|---|---|
| | C | Si | Mn | P | S | Al | N | O | B | Others |
| A | 0.114 | 1.20 | 2.90 | 0.015 | 0.0010 | 0.042 | 0.0050 | 0.0013 | 0.0020 | — |
| B | 0.183 | 0.90 | 3.31 | 0.010 | 0.0008 | 0.040 | 0.0041 | 0.0025 | 0.0015 | — |
| C | 0.142 | 0.75 | 3.11 | 0.011 | 0.0007 | 0.061 | 0.0056 | 0.0009 | 0.0015 | — |
| D | 0.161 | 1.15 | 3.21 | 0.010 | 0.0009 | 0.050 | 0.0045 | 0.0020 | 0.0013 | Sb: 0.007 |
| E | 0.172 | 1.03 | 2.41 | 0.015 | 0.0013 | 0.038 | 0.0035 | 0.0011 | 0.0015 | Cr: 0.20, Ca: 0.0035 |
| F | 0.122 | 0.73 | 3.48 | 0.015 | 0.0010 | 0.045 | 0.0045 | 0.0020 | 0.0018 | — |
| G | 0.134 | 1.08 | 2.77 | 0.005 | 0.0006 | 0.040 | 0.0035 | 0.0016 | 0.0025 | Cr: 0.30 |
| H | 0.144 | 0.89 | 2.47 | 0.009 | 0.0017 | 1.910 | 0.0055 | 0.0012 | 0.0006 | Cr: 0.60, Sb: 0.019 |
| I | 0.139 | 0.96 | 2.96 | 0.011 | 0.0009 | 0.050 | 0.0040 | 0.0009 | 0.0017 | Mo: 0.23 |
| J | 0.142 | 0.88 | 2.55 | 0.021 | 0.0006 | 0.037 | 0.0029 | 0.0007 | 0.0020 | Mo: 0.41 |
| K | 0.118 | 0.72 | 2.43 | 0.012 | 0.0013 | 0.048 | 0.0036 | 0.0011 | 0.0032 | Mo: 0.34 |
| L | 0.163 | 1.06 | 3.56 | 0.008 | 0.0006 | 0.040 | 0.0028 | 0.0023 | 0.0095 | Cu: 1.02 |
| M | 0.145 | 0.99 | 2.96 | 0.014 | 0.0023 | 0.047 | 0.0038 | 0.0010 | 0.0010 | Ni: 0.48, Mg: 0.0022 |
| N | 0.122 | 1.15 | 2.88 | 0.013 | 0.0009 | 0.043 | 0.0040 | 0.0010 | 0.0015 | Ti: 0.021, REM: 0.0016 |
| O | 0.108 | 1.11 | 2.77 | 0.019 | 0.0018 | 0.041 | 0.0098 | 0.0013 | 0.0007 | Ti: 0.082, Nb: 0.037 |
| P | 0.125 | 0.99 | 2.82 | 0.034 | 0.0008 | 0.041 | 0.0041 | 0.0012 | 0.0009 | Ti: 0.125, V: 0.013 |
| Q | 0.070 | 0.69 | 1.80 | 0.0018 | 0.0025 | 0.043 | 0.0052 | 0.0031 | 0.0016 | Cr: 0.45, Ti: 0.12 |
| a | 0.043 | 1.05 | 2.50 | 0.029 | 0.0012 | 0.031 | 0.0044 | 0.0021 | 0.0017 | — |
| b | 0.212 | 0.99 | 3.08 | 0.012 | 0.0039 | 0.028 | 0.0035 | 0.0024 | 0.0016 | — |
| c | 0.145 | 0.35 | 3.42 | 0.025 | 0.0031 | 0.045 | 0.0055 | 0.0011 | 0.0019 | — |
| d | 0.138 | 0.87 | 2.81 | 0.013 | 0.0012 | 0.052 | 0.0037 | 0.0012 | 0.0003 | — |
| e | 0.142 | 0.96 | 1.24 | 0.020 | 0.0015 | 0.065 | 0.0042 | 0.0025 | 0.0019 | Cr: 0.80 |
| f | 0.133 | 0.71 | 4.05 | 0.010 | 0.0015 | 0.047 | 0.0062 | 0.0011 | 0.0014 | — |
| g | 0.149 | 0.88 | 2.16 | 0.016 | 0.0017 | 0.055 | 0.0038 | 0.0011 | 0.0019 | Cr: 0.18 |
| h | 0.126 | 1.12 | 3.25 | 0.016 | 0.0015 | 0.045 | 0.0042 | 0.0009 | 0.0026 | Cr: 0.47 |
| i | 0.118 | 1.17 | 3.05 | 0.009 | 0.0009 | 0.051 | 0.0036 | 0.0017 | 0.0020 | Cr: 1.10 |
| j | 0.140 | 0.92 | 2.95 | 0.108 | 0.0014 | 0.042 | 0.0041 | 0.0021 | 0.0008 | Ti: 0.350 |

| Type of steel | MSC (% by mass) | RC1 (° C.) | RC2 (° C.) | Trs (° C.) | RC2 − 50 (° C.) | RC2 + 120 (° C.) | Trs + 250 (° C.) | Notes |
|---|---|---|---|---|---|---|---|---|
| A | 3.14 | 951 | 801 | 347 | 751 | 921 | 597 | Conforming steel |
| B | 3.49 | 959 | 809 | 302 | 759 | 929 | 552 | Conforming steel |
| C | 3.26 | 953 | 803 | 327 | 753 | 923 | 577 | Conforming steel |
| D | 3.44 | 955 | 805 | 315 | 755 | 925 | 565 | Conforming steel |
| E | 2.96 | 951 | 801 | 335 | 751 | 921 | 585 | Conforming steel |
| F | 3.63 | 956 | 806 | 323 | 756 | 926 | 573 | Conforming steel |
| G | 3.50 | 957 | 807 | 338 | 757 | 927 | 588 | Conforming steel |
| H | 3.67 | 949 | 799 | 340 | 749 | 919 | 590 | Conforming steel |
| I | 3.73 | 964 | 814 | 329 | 764 | 934 | 579 | Conforming steel |
| J | 3.75 | 970 | 820 | 339 | 770 | 940 | 589 | Conforming steel |
| K | 3.42 | 969 | 819 | 355 | 769 | 939 | 605 | Conforming steel |
| L | 3.77 | 1000 | 850 | 302 | 800 | 970 | 552 | Conforming steel |
| M | 3.16 | 949 | 799 | 326 | 749 | 919 | 576 | Conforming steel |
| N | 3.11 | 964 | 806 | 344 | 756 | 926 | 594 | Conforming steel |
| O | 2.99 | 1074 | 859 | 354 | 809 | 979 | 604 | Conforming steel |
| P | 3.02 | 1035 | 841 | 345 | 791 | 961 | 595 | Conforming steel |
| Q | 2.70 | 1022 | 830 | 399 | 780 | 950 | 649 | Conforming steel |
| a | 2.71 | 938 | 788 | 393 | 738 | 908 | 643 | Comparative steel |
| b | 3.28 | 960 | 810 | 297 | 760 | 930 | 547 | Comparative steel |
| c | 3.49 | 959 | 809 | 315 | 759 | 929 | 565 | Comparative steel |
| d | 2.98 | 944 | 794 | 340 | 744 | 914 | 590 | Comparative steel |
| e | 2.80 | 945 | 795 | 381 | 745 | 915 | 631 | Comparative steel |
| f | 4.19 | 961 | 811 | 298 | 761 | 931 | 548 | Comparative steel |
| g | 2.64 | 948 | 798 | 355 | 748 | 918 | 605 | Comparative steel |
| h | 4.27 | 963 | 813 | 323 | 763 | 933 | 573 | Comparative steel |
| i | 5.15 | 964 | 814 | 324 | 764 | 934 | 574 | Comparative steel |
| j | 3.13 | 1193 | 920 | 334 | 870 | 1040 | 584 | Comparative steel |

The underlines are outside the scope of the present invention.

* The remainder is composed of Fe and incidental impurities.

TABLE 2

| | | Manufacturing conditions | | | | | |
|---|---|---|---|---|---|---|---|
| | | | Hot rolling | | | | First cooling |
| No. | Type of steel | Heating Heating temperature (° C.) | Number of descaling operations (times) | Water pressure of descaling performed within 5 seconds before start of finish rolling (MPa) | Total rolling reduction at temperature of RC1 or less (%) | Finishing temperature (° C.) | Time from completion of hot rolling to start of cooling (s) |
| 1 | A | 1250 | 3 | 60 | 35 | 840 | 1.0 |
| 2 | A | 1210 | 4 | 65 | 45 | 920 | 1.4 |
| 3 | A | 1210 | 3 | 35 | 45 | 910 | 0.5 |
| 4 | A | 1200 | 5 | 55 | 30 | 870 | 0.8 |
| 5 | A | 1240 | 3 | 60 | 35 | 880 | 1.0 |
| 6 | B | 1230 | 3 | 60 | 45 | 875 | 1.6 |
| 7 | C | 1220 | 4 | 65 | 35 | 855 | 1.0 |
| 8 | D | 1220 | 3 | 80 | 60 | 865 | 0.6 |
| 9 | E | 1270 | 4 | 70 | 30 | 845 | 0.8 |
| 10 | F | 1200 | 3 | 60 | 45 | 875 | 1.0 |
| 11 | G | 1250 | 4 | 70 | 50 | 820 | 1.4 |
| 12 | G | 1230 | 3 | 65 | 35 | 920 | 0.5 |
| 13 | G | 1260 | 5 | 90 | 45 | 880 | 0.8 |
| 14 | G | 1240 | 4 | 70 | 30 | 885 | 1.0 |
| 15 | H | 1230 | 2 | 60 | 60 | 865 | 1.6 |
| 16 | I | 1250 | 3 | 65 | 40 | 850 | 1.0 |
| 17 | J | 1240 | 4 | 75 | 30 | 880 | 0.6 |
| 18 | K | 1235 | 5 | 60 | 35 | 860 | 0.8 |
| 19 | L | 1210 | 3 | 65 | 50 | 920 | 1.4 |
| 20 | M | 1235 | 3 | 55 | 45 | 870 | 0.5 |
| 21 | N | 1220 | 4 | 60 | 50 | 860 | 0.8 |
| 22 | O | 1300 | 4 | 70 | 60 | 940 | 1.0 |
| 23 | P | 1270 | 3 | 60 | 75 | 890 | 1.6 |
| 24 | Q | 1240 | 4 | 65 | 40 | 900 | 1.0 |
| 25 | a | 1250 | 4 | 70 | 35 | 900 | 0.6 |
| 26 | b | 1220 | 3 | 70 | 40 | 900 | 0.8 |
| 27 | c | 1210 | 3 | 65 | 55 | 890 | 1.0 |
| 28 | d | 1215 | 4 | 60 | 40 | 905 | 1.4 |
| 29 | e | 1230 | 3 | 65 | 35 | 895 | 0.5 |
| 30 | f | 1260 | 4 | 60 | 45 | 905 | 0.8 |
| 31 | g | 1240 | 3 | 80 | 50 | 910 | 1.0 |
| 32 | h | 1245 | 4 | 70 | 65 | 900 | 1.6 |
| 33 | i | 1220 | 3 | 60 | 35 | 910 | 1.0 |
| 34 | j | 1290 | 5 | 70 | 75 | 930 | 1.4 |
| 35 | A | 1240 | 4 | 10 | 35 | 840 | 0.5 |
| 36 | A | 1245 | 2 | 70 | 15 | 900 | 0.8 |
| 37 | A | 1240 | 3 | 60 | 90 | 870 | 1.0 |
| 38 | A | 1250 | 4 | 65 | 45 | 745 | 1.6 |
| 39 | A | 1230 | 5 | 75 | 30 | 1020 | 1.0 |
| 40 | A | 1270 | 3 | 60 | 50 | 915 | 0.6 |
| 41 | A | 1260 | 3 | 65 | 40 | 900 | 0.8 |
| 42 | A | 1240 | 3 | 55 | 30 | 910 | 1.0 |
| 43 | A | 1240 | 4 | 60 | 40 | 895 | 1.4 |
| 44 | B | 1220 | 3 | 70 | 40 | 750 | 0.5 |
| 45 | C | 1190 | 4 | 60 | 35 | 1040 | 0.8 |
| 46 | D | 1215 | 3 | 65 | 30 | 920 | 1.0 |
| 47 | E | 1230 | 4 | 75 | 40 | 880 | 1.2 |
| 48 | G | 1250 | 3 | 60 | 60 | 915 | 0.6 |
| 49 | H | 1230 | 3 | 70 | 50 | 915 | 1.8 |

| | Manufacturing conditions | | | | | |
|---|---|---|---|---|---|---|
| | First cooling | | | Second cooling | | |
| No. | Average cooling rate (° C./s) | Cooling stop temperature (° C.) | Coiling Coiling temperature (° C.) | Average cooling rate (° C./s) | Cooling stop temperature (° C.) | Notes |
| 1 | 60 | 435 | 445 | 5 | 50 | Example |
| 2 | 45 | 470 | 460 | 8 | 55 | Example |
| 3 | 45 | 465 | 455 | 8 | 55 | Example |
| 4 | 80 | 360 | 375 | 4 | 35 | Example |
| 5 | 55 | 570 | 550 | 6 | 80 | Example |
| 6 | 75 | 455 | 470 | 11 | 45 | Example |
| 7 | 37 | 530 | 520 | 15 | 75 | Example |
| 8 | 92 | 425 | 445 | 5 | 40 | Example |
| 9 | 75 | 500 | 490 | 7 | 80 | Example |

TABLE 2-continued

| | | | | | | |
|---|---|---|---|---|---|---|
| 10 | 62 | 360 | 390 | 3 | 40 | Example |
| 11 | 55 | 410 | 420 | 3 | 50 | Example |
| 12 | 38 | 405 | 430 | 7 | 70 | Example |
| 13 | 32 | 355 | 345 | 4 | 85 | Example |
| 14 | 95 | 580 | 570 | 8 | 75 | Example |
| 15 | 47 | 420 | 440 | 6 | 70 | Example |
| 16 | 38 | 475 | 490 | 4 | 55 | Example |
| 17 | 46 | 520 | 510 | 9 | 70 | Example |
| 18 | 58 | 405 | 430 | 5 | 50 | Example |
| 19 | 92 | 385 | 410 | 6 | 55 | Example |
| 20 | 62 | 500 | 495 | 7 | 80 | Example |
| 21 | 38 | 410 | 430 | 7 | 55 | Example |
| 22 | 77 | 525 | 510 | 4 | 35 | Example |
| 23 | 64 | 540 | 530 | 9 | 75 | Example |
| 24 | 70 | 460 | 440 | 6 | 70 | Example |
| 25 | 88 | 400 | 420 | 10 | 35 | Comparative example |
| 26 | 29 | 450 | 470 | 8 | 45 | Comparative example |
| 27 | 16 | 400 | 435 | 6 | 50 | Comparative example |
| 28 | 46 | 390 | 425 | 4 | 25 | Comparative example |
| 29 | 32 | 520 | 510 | 5 | 50 | Comparative example |
| 30 | 67 | 500 | 480 | 3 | 85 | Comparative example |
| 31 | 70 | 420 | 430 | 6 | 60 | Comparative example |
| 32 | 82 | 425 | 440 | 4 | 60 | Comparative example |
| 33 | 78 | 400 | 430 | 3 | 80 | Comparative example |
| 34 | 57 | 520 | 510 | 7 | 50 | Comparative example |
| 35 | 60 | 435 | 445 | 5 | 50 | Comparative example |
| 36 | 60 | 480 | 465 | 8 | 60 | Comparative example |
| 37 | 55 | 470 | 435 | 5 | 45 | Comparative example |
| 38 | 50 | 430 | 450 | 5 | 35 | Comparative example |
| 39 | 70 | 525 | 510 | 3 | 45 | Comparative example |
| 40 | 4 | 420 | 440 | 3 | 85 | Comparative example |
| 41 | 45 | 310 | 330 | 4 | 55 | Comparative example |
| 42 | 50 | 650 | 630 | 3 | 75 | Comparative example |
| 43 | 37 | 450 | 470 | 25 | 35 | Comparative example |
| 44 | 49 | 430 | 440 | 6 | 55 | Comparative example |
| 45 | 56 | 390 | 410 | 3 | 50 | Comparative example |
| 46 | 3 | 430 | 460 | 2 | 35 | Comparative example |
| 47 | 34 | 280 | 300 | 6 | 55 | Comparative example |
| 48 | 28 | 670 | 630 | 3 | 65 | Comparative example |
| 49 | 67 | 525 | 510 | 35 | 30 | Comparative example |

The underlines are outside the scope of the present invention.

TABLE 3

| | | Microstructure | | | | | | | | | | | | | |
|---|---|---|---|---|---|---|---|---|---|---|---|---|---|---|---|
| | Type | Area ratio (%) | | | | | | | | | | | | Average grain size of surface layer microstructure (μm) | |
| | of | Surface layer | | | | | | Inside | | | | | | | |
| No. | steel | UB | M | γ | M + γ | F | TM | UB | M | γ | M + γ | F | TM | UB | M and/or γ |
| 1 | A | 90 | 8 | 2 | 10 | 0 | 0 | 88 | 9 | 3 | 12 | 0 | 0 | 5.4 | 3.4 |
| 2 | A | 88 | 11 | 1 | 12 | 0 | 0 | 86 | 12 | 2 | 14 | 0 | 0 | 5.1 | 4.0 |
| 3 | A | 87 | 10 | 1 | 11 | 0 | 0 | 86 | 12 | 2 | 14 | 0 | 0 | 5.1 | 3.8 |
| 4 | A | 93 | 5 | 2 | 7 | 0 | 0 | 91 | 6 | 3 | 9 | 0 | 0 | 4.9 | 3.6 |
| 5 | A | 83 | 13 | 4 | 17 | 0 | 0 | 81 | 14 | 5 | 19 | 0 | 0 | 5.5 | 3.9 |
| 6 | B | 82 | 13 | 5 | 18 | 0 | 0 | 80 | 14 | 6 | 20 | 0 | 0 | 5.2 | 4.0 |
| 7 | C | 89 | 6 | 5 | 11 | 0 | 0 | 87 | 7 | 6 | 13 | 0 | 0 | 4.6 | 3.2 |
| 8 | D | 85 | 12 | 3 | 15 | 0 | 0 | 83 | 13 | 4 | 17 | 0 | 0 | 3.8 | 3.1 |
| 9 | E | 90 | 6 | 4 | 10 | 0 | 0 | 88 | 7 | 5 | 12 | 0 | 0 | 5.9 | 3.6 |
| 10 | F | 82 | 16 | 2 | 18 | 0 | 0 | 80 | 17 | 3 | 20 | 0 | 0 | 5.3 | 3.3 |
| 11 | G | 85 | 12 | 3 | 15 | 0 | 0 | 83 | 13 | 4 | 17 | 0 | 0 | 5.1 | 2.6 |
| 12 | G | 85 | 13 | 2 | 15 | 0 | 0 | 83 | 14 | 3 | 17 | 0 | 0 | 4.9 | 3.5 |
| 13 | G | 92 | 5 | 3 | 8 | 0 | 0 | 90 | 6 | 4 | 10 | 0 | 0 | 5.8 | 3.0 |
| 14 | G | 75 | 20 | 5 | 25 | 0 | 0 | 73 | 21 | 6 | 27 | 0 | 0 | 4.7 | 2.5 |
| 15 | H | 74 | 20 | 6 | 26 | 0 | 0 | 72 | 21 | 7 | 28 | 0 | 0 | 4.2 | 3.6 |
| 16 | I | 86 | 11 | 3 | 14 | 0 | 0 | 84 | 12 | 4 | 16 | 0 | 0 | 5.7 | 3.0 |
| 17 | J | 85 | 12 | 3 | 15 | 0 | 0 | 83 | 13 | 4 | 17 | 0 | 0 | 5.8 | 2.7 |
| 18 | K | 77 | 18 | 5 | 23 | 0 | 0 | 75 | 19 | 6 | 25 | 0 | 0 | 5.2 | 3.2 |
| 19 | L | 80 | 16 | 4 | 20 | 0 | 0 | 78 | 17 | 5 | 22 | 0 | 0 | 4.9 | 2.9 |
| 20 | M | 86 | 13 | 1 | 14 | 0 | 0 | 84 | 14 | 2 | 16 | 0 | 0 | 5.4 | 4.0 |
| 21 | N | 88 | 9 | 3 | 12 | 0 | 0 | 86 | 10 | 4 | 14 | 0 | 0 | 5.2 | 3.9 |
| 22 | O | 86 | 10 | 4 | 14 | 0 | 0 | 84 | 11 | 5 | 16 | 0 | 0 | 4.1 | 3.3 |
| 23 | P | 90 | 8 | 2 | 10 | 0 | 0 | 88 | 9 | 3 | 12 | 0 | 0 | 3.8 | 2.1 |

TABLE 3-continued

| | | | | | | | | | | | | | | | |
|---|---|---|---|---|---|---|---|---|---|---|---|---|---|---|---|
| 24 | Q | 98 | 2 | 0 | 2 | 0 | 0 | 94 | 2 | 1 | 3 | 0 | 0 | 4.2 | 1.9 |
| 25 | a | 94 | 5 | 1 | 6 | 0 | 0 | 92 | 6 | 2 | 8 | 0 | 0 | 6.4 | 2.1 |
| 26 | b | 91 | 6 | 3 | 9 | 0 | 0 | 89 | 7 | 4 | 11 | 0 | 0 | 5.7 | 4.0 |
| 27 | c | 99 | 1 | 0 | 1 | 0 | 0 | 98 | 2 | 0 | 2 | 0 | 0 | 4.8 | 3.2 |
| 28 | d | 69 | 27 | 4 | 31 | 0 | 0 | 68 | 26 | 6 | 32 | 0 | 0 | 6.2 | 4.0 |
| 29 | e | 100 | 0 | 0 | 0 | 0 | 0 | 99 | 1 | 0 | 1 | 0 | 0 | 5.5 | 0.0 |
| 30 | f | 69 | 26 | 5 | 31 | 0 | 0 | 69 | 26 | 5 | 31 | 0 | 0 | 5.7 | 3.7 |
| 31 | g | 99 | 1 | 0 | 1 | 0 | 0 | 99 | 1 | 0 | 1 | 0 | 0 | 4.9 | 2.9 |
| 32 | h | 68 | 26 | 6 | 32 | 0 | 0 | 66 | 27 | 7 | 34 | 0 | 0 | 4.3 | 2.8 |
| 33 | i | 69 | 24 | 7 | 31 | 0 | 0 | 69 | 24 | 7 | 31 | 0 | 0 | 5.2 | 3.2 |
| 34 | j | 69 | 29 | 2 | 31 | 0 | 0 | 67 | 30 | 3 | 33 | 0 | 0 | 3.2 | 3.0 |
| 35 | A | 91 | 7 | 2 | 9 | 0 | 0 | 89 | 8 | 3 | 11 | 0 | 0 | 5.2 | 3.3 |
| 36 | A | 91 | 8 | 1 | 9 | 0 | 0 | 89 | 9 | 2 | 11 | 0 | 0 | 8.3 | 2.5 |
| 37 | A | 94 | 5 | 1 | 6 | 0 | 0 | 92 | 6 | 2 | 8 | 0 | 0 | 1.8 | 3.6 |
| 38 | A | 90 | 7 | 3 | 10 | 0 | 0 | 88 | 8 | 4 | 12 | 0 | 0 | 5.7 | 3.0 |
| 39 | A | 89 | 9 | 2 | 11 | 0 | 0 | 87 | 10 | 3 | 13 | 0 | 0 | 7.5 | 2.7 |
| 40 | A | 69 | 16 | 5 | 21 | 10 | 0 | 68 | 17 | 5 | 22 | 10 | 0 | 4.8 | 3.2 |
| 41 | A | 7 | 1 | 0 | 1 | 0 | 92 | 6 | 2 | 0 | 2 | 0 | 92 | 5.3 | 2.9 |
| 42 | A | 0 | 0 | 0 | 0 | 100 | 0 | 0 | 0 | 0 | 0 | 100 | 0 | 5.6 | 0.0 |
| 43 | A | 67 | 31 | 2 | 33 | 0 | 0 | 65 | 32 | 3 | 35 | 0 | 0 | 5.2 | 3.9 |
| 44 | B | 92 | 6 | 2 | 8 | 0 | 0 | 90 | 7 | 3 | 10 | 0 | 0 | 5.1 | 3.0 |
| 45 | C | 90 | 7 | 3 | 10 | 0 | 0 | 88 | 8 | 4 | 12 | 0 | 0 | 9.0 | 2.5 |
| 46 | D | 0 | 0 | 0 | 0 | 100 | 0 | 0 | 0 | 0 | 0 | 100 | 0 | 5.4 | 0.0 |
| 47 | E | 4 | 0 | 0 | 0 | 0 | 96 | 3 | 0 | 1 | 1 | 0 | 96 | 5.6 | 2.0 |
| 48 | G | 0 | 0 | 0 | 0 | 100 | 0 | 0 | 0 | 0 | 0 | 100 | 0 | 7.6 | 0.0 |
| 49 | H | 2 | 95 | 3 | 98 | 0 | 0 | 0 | 96 | 4 | 100 | 0 | 0 | 6.3 | 4.0 |

| No. | Microstructure Number density of M and/or γ in surface layer (×100/mm²) | Surface roughness Ry (μm) | Mechanical properties YP (MPa) | TS (MPa) | YR (%) | EI (%) | u − EI (%) | $10^7$-cycle plane bending fatigue strength σw (MPa) | Fatigue limit ratio σw/TS (—) | Notes |
|---|---|---|---|---|---|---|---|---|---|---|
| 1 | 4.0 | 15.0 | 1000 | 1232 | 81 | 15.9 | 7.1 | 591 | 0.48 | Example |
| 2 | 5.0 | 11.0 | 976 | 1195 | 82 | 17.8 | 9.2 | 621 | 0.52 | Example |
| 3 | 5.5 | 25.0 | 976 | 1195 | 82 | 17.8 | 9.2 | 550 | 0.46 | Example |
| 4 | 6.0 | 12.0 | 1025 | 1273 | 80 | 14.6 | 8.4 | 700 | 0.55 | Example |
| 5 | 4.0 | 15.0 | 951 | 1221 | 78 | 16.7 | 7.3 | 733 | 0.60 | Example |
| 6 | 6.0 | 15.0 | 1068 | 1325 | 81 | 12.7 | 6.7 | 649 | 0.49 | Example |
| 7 | 5.0 | 12.0 | 1028 | 1228 | 84 | 13.8 | 7.2 | 639 | 0.52 | Example |
| 8 | 4.0 | 10.0 | 1080 | 1270 | 85 | 16.9 | 9.1 | 648 | 0.51 | Example |
| 9 | 3.0 | 12.5 | 1102 | 1252 | 88 | 16.2 | 8.8 | 601 | 0.48 | Example |
| 10 | 6.0 | 15.0 | 1116 | 1298 | 86 | 13.9 | 6.1 | 636 | 0.49 | Example |
| 11 | 3.0 | 12.5 | 1004 | 1255 | 80 | 14.8 | 7.2 | 678 | 0.54 | Example |
| 12 | 6.0 | 13.8 | 1023 | 1263 | 81 | 14.7 | 7.3 | 733 | 0.58 | Example |
| 13 | 4.0 | 5.0 | 1121 | 1350 | 83 | 13.8 | 6.5 | 702 | 0.52 | Example |
| 14 | 2.0 | 12.5 | 1057 | 1215 | 87 | 17.2 | 7.8 | 668 | 0.55 | Example |
| 15 | 5.0 | 15.0 | 993 | 1196 | 83 | 17.2 | 8.8 | 706 | 0.59 | Example |
| 16 | 3.0 | 13.8 | 954 | 1239 | 77 | 15.8 | 8.2 | 644 | 0.52 | Example |
| 17 | 3.0 | 10.0 | 980 | 1238 | 79 | 15.9 | 8.7 | 607 | 0.49 | Example |
| 18 | 4.0 | 13.0 | 1010 | 1246 | 81 | 16.2 | 9.0 | 673 | 0.54 | Example |
| 19 | 6.0 | 13.8 | 1118 | 1285 | 87 | 13.9 | 7.1 | 720 | 0.56 | Example |
| 20 | 2.0 | 14.0 | 950 | 1203 | 79 | 15.9 | 8.1 | 638 | 0.53 | Example |
| 21 | 3.0 | 15.0 | 1004 | 1210 | 83 | 14.9 | 8.1 | 666 | 0.55 | Example |
| 22 | 7.0 | 12.5 | 1036 | 1205 | 86 | 15.7 | 9.3 | 627 | 0.52 | Example |
| 23 | 4.0 | 15.0 | 1125 | 1278 | 88 | 13.5 | 7.5 | 767 | 0.60 | Example |
| 24 | 3.0 | 13.8 | 980 | 1050 | 93 | 18.1 | 8.9 | 578 | 0.55 | Example |
| 25 | 2.0 | 12.5 | 870 | 970 | 90 | 18.3 | 9.6 | 437 | 0.45 | Comparative example |
| 26 | 1.0 | 12.5 | 1265 | 1390 | 91 | 13.2 | 3.8 | 459 | 0.33 | Comparative example |
| 27 | 3.0 | 13.8 | 1080 | 1270 | 85 | 13.1 | 4.9 | 495 | 0.39 | Comparative example |
| 28 | 5.0 | 15.0 | 1096 | 1260 | 87 | 15.2 | 4.8 | 479 | 0.38 | Comparative example |
| 29 | 0.0 | 13.8 | 1081 | 1175 | 92 | 16.4 | 6.6 | 423 | 0.36 | Comparative example |
| 30 | 3.0 | 15.0 | 871 | 1340 | 65 | 11.8 | 4.2 | 429 | 0.32 | Comparative example |
| 31 | 0.5 | 10.0 | 1089 | 1210 | 90 | 13.3 | 4.7 | 399 | 0.33 | Comparative example |
| 32 | 3.0 | 12.5 | 856 | 1380 | 62 | 12.9 | 5.1 | 621 | 0.45 | Comparative example |
| 33 | 4.0 | 15.0 | 931 | 1410 | 66 | 10.8 | 3.2 | 423 | 0.30 | Comparative example |
| 34 | 3.0 | 12.5 | 1100 | 1390 | 79 | 11.7 | 5.2 | 445 | 0.32 | Comparative example |
| 35 | 4.0 | 32.0 | 1011 | 1243 | 81 | 15.3 | 6.9 | 447 | 0.36 | Comparative example |
| 36 | 4.0 | 12.5 | 1002 | 1178 | 85 | 13.8 | 6.4 | 412 | 0.35 | Comparative example |
| 37 | 3.0 | 15.0 | 1167 | 1260 | 93 | 12.2 | 5.4 | 567 | 0.45 | Comparative example |
| 38 | 6.0 | 13.8 | 1158 | 1379 | 84 | 12.9 | 5.1 | 634 | 0.46 | Comparative example |
| 39 | 3.0 | 11.3 | 863 | 1150 | 75 | 13.8 | 7.2 | 437 | 0.38 | Comparative example |
| 40 | 6.0 | 15.0 | 882 | 975 | 90 | 13.8 | 7.2 | 439 | 0.45 | Comparative example |
| 41 | 0.5 | 13.8 | 1136 | 1420 | 80 | 9.8 | 3.2 | 483 | 0.34 | Comparative example |

TABLE 3-continued

| | | | | | | | | | | |
|---|---|---|---|---|---|---|---|---|---|---|
| 42 | 0.0 | 16.3 | 840 | 940 | 89 | 14.8 | 7.2 | 508 | 0.54 | Comparative example |
| 43 | 5.0 | 15.0 | 897 | 1150 | 78 | 13.7 | 5.3 | 472 | 0.41 | Comparative example |
| 44 | 3.0 | 12.5 | 1126 | 1340 | 84 | 12.6 | 5.4 | 616 | 0.46 | Comparative example |
| 45 | 3.0 | 15.0 | 905 | 970 | 93 | 15.0 | 7.1 | 320 | 0.33 | Comparative example |
| 46 | 0.0 | 13.8 | 797 | 960 | 83 | 17.8 | 9.2 | 461 | 0.48 | Comparative example |
| 47 | 2.0 | 11.3 | 1358 | 1460 | 93 | 8.8 | 3.2 | 526 | 0.36 | Comparative example |
| 48 | 0.0 | 15.0 | 930 | 970 | 96 | 14.7 | 8.3 | 369 | 0.38 | Comparative example |
| 49 | 5.0 | 12.5 | 1163 | 1510 | 77 | 7.9 | 3.1 | 498 | 0.33 | Comparative example |

The underlines are outside the scope of the present invention.
UB: upper bainite
M: fresh martensite
γ: retained austenite
F: polygonal ferrite
TM: tempered martensite The results in Table 3 show that all the examples have a tensile strength of 980 MPa or more, high press formability, and high fatigue resistance.

The invention claimed is:

1. A high-strength steel sheet comprising:

a chemical composition containing, in mass %:

C: 0.05% to 0.20%,
Si: 0.6% to 1.2%,
Mn: 1.3% to 3.7%,
P: 0.10% or less,
S: 0.03% or less,
Al: 0.001% to 2.0%,
N: 0.01% or less,
O: 0.01% or less,
B: 0.0005% to 0.010%, the remainder being Fe and incidental impurities, and MSC value defined by the following formula (1) in the range of 2.7% to 3.8% by mass;

a microstructure in a surface layer region extending from a surface of the steel sheet to a depth of 100 μm containing 70% by area or more of upper bainite and 2% by area or more of fresh martensite and/or retained austenite in total, the upper bainite having an average grain size of 7 μm or less, the fresh martensite and/or retained austenite having an average grain size of 4 μm or less, and the fresh martensite and/or retained austenite having a number density of 100/mm$^2$ or more; and a microstructure in an inner region other than the surface layer region containing 70% by area or more of upper bainite and 3% by area or more of fresh martensite and/or retained austenite in total, wherein the high-strength steel sheet has:

a maximum height of a surface roughness of 30 μm or less, and;

a tensile strength of 980 MPa or more, and a uniform elongation of 6% or more, and a ratio of $10^7$-cycle plane bending fatigue strength to tensile strength (fatigue limit ratio) of 0.45 or more, $$\text{MSC (\% by mass)} = \text{Mn} + 0.2\times\text{Si} + 1.7\times\text{Cr} + 2.5\times\text{Mo} \quad (1)$$

where each element symbol in the formula (1) denotes a corresponding element content (% by mass) and is 0 in the absence of the element.

2. The high-strength steel sheet according to claim 1, wherein the area of fresh martensite and/or retained austenite in total in the surface layer region is smaller than the area of fresh martensite and/or retained austenite in total in the inner region.

3. The high-strength steel sheet according to claim 1, wherein the chemical composition further contains at least one selected from following groups A to D consisting of:

Group A: in mass %, at least one of
Cr: 1.0% or less and
Mo: 1.0% or less;

Group B: in mass %, at least one of
Cu: 2.0% or less,
Ni: 2.0% or less,
Ti: 0.3% or less,
Nb: 0.3% or less, and
V: 0.3% or less;

Group C: in mass %,
Sb: 0.005% to 0.020%; and

Group D: in mass %, at least one of
Ca: 0.01% or less,
Mg: 0.01% or less, and
REM: 0.01% or less.

4. The high-strength steel sheet according to claim 2, wherein the chemical composition further contains at least one selected from following groups A to D consisting of:

Group A: in mass %, at least one of
Cr: 1.0% or less and
Mo: 1.0% or less;

Group B: in mass %, at least one of
Cu: 2.0% or less,
Ni: 2.0% or less,
Ti: 0.3% or less,
Nb: 0.3% or less, and
V: 0.3% or less;

Group C: in mass %,
Sb: 0.005% to 0.020%; and

Group D: in mass %, at least one of
Ca: 0.01% or less,
Mg: 0.01% or less, and
REM: 0.01% or less.

5. A method for manufacturing the high-strength steel sheet according to claim 1, comprising:

heating a steel material having the chemical composition to a heating temperature of 1150° C. or more;

hot rolling including rough rolling and finish rolling the steel material after the heating into a hot-rolled steel sheet, while performing descaling at least twice between start of the rough rolling and start of the finish rolling including performing the descaling with a water pressure of 15 MPa or more once or more within 5 seconds before the start of the finish rolling, the finish rolling being performed under conditions of a finishing temperature: (RC2-50° C.) or more and (RC2+120° C.) or less and a total rolling reduction of 25% or more and 80% or less at a temperature of RC1 or less;

cooling the hot-rolled steel sheet under conditions of a time from completion of the hot rolling to start of cooling: 2.0 seconds or less, an average cooling rate: 5° C./s or more, and a cooling stop temperature: Trs or more and (Trs+250° C.) or less;

coiling the hot-rolled steel sheet after the cooling at a coiling temperature: Trs or more and (Trs+250° C.) or less; and cooling the hot-rolled steel sheet to 100° C. or less with an average cooling rate of 20° C./s or less, wherein RC1, RC2, and Trs are represented by the following formulae (2), (3), and (4), respectively, $$RC1(°\ C.)=900+100\times C+100\times N+10\times Mn+700\times Ti+5000\times B+10\times Cr+50\times Mo+2000\times Nb+150\times V \quad (2)$$

$$RC2(°\ C.)=750+100\times C+100\times N+10\times Mn+350\times Ti+5000\times B+10\times Cr+50\times Mo+1000\times Nb+150\times V \quad (3)$$

$$Trs(°\ C.)=500-450\times C-35\times Mn-15\times Cr-10\times Ni-20\times Mo \quad (4)$$

where each element symbol in the formulae (2), (3), and (4) denotes a corresponding element content (% by mass) and is 0 in the absence of the element.

6. A method for manufacturing the high-strength steel sheet according to claim 2, comprising:

heating a steel material having the chemical composition to a heating temperature of 1150° C. or more;

hot rolling including rough rolling and finish rolling the steel material after the heating into a hot-rolled steel sheet while performing descaling at least twice between start of the rough rolling and start of the finish rolling including performing the descaling with a water pressure of 15 MPa or more once or more within 5 seconds before the start of the finish rolling, the finish rolling being performed under conditions of a finishing temperature: (RC2-50° C.) or more and (RC2+120° C.) or less and a total rolling reduction of 25% or more and 80% or less at a temperature of RC1 or less;

cooling the hot-rolled steel sheet under conditions of a time from completion of the hot rolling to start of cooling: 2.0 seconds or less, an average cooling rate: 5° C./s or more, and a cooling stop temperature: Trs or more and (Trs+250° C.) or less;

coiling the hot-rolled steel sheet after the cooling at a coiling temperature: Trs or more and (Trs+250° C.) or less; and cooling the hot-rolled steel sheet to 100° C. or less with an average cooling rate of 20° C./s or less, wherein RC1, RC2, and Trs are represented by the following formulae (2), (3), and (4), respectively, $$RC1(°\ C.)=900+100\times C+100\times N+10\times Mn+700\times Ti+5000\times B+10\times Cr+50\times Mo+2000\times Nb+150\times V \quad (2)$$

$$RC2(°\ C.)=750+100\times C+100\times N+10\times Mn+350\times Ti+5000\times B+10\times Cr+50\times Mo+1000\times Nb+150\times V \quad (3)$$

$$Trs(°\ C.)=500-450\times C-35\times Mn-15\times Cr-10\times Ni-20\times Mo \quad (4)$$

where each element symbol in the formulae (2), (3), and (4) denotes a corresponding element content (% by mass) and is 0 in the absence of the element.

7. A method for manufacturing the high-strength steel sheet according to claim 3, comprising:

heating a steel material having the chemical composition to a heating temperature of 1150° C. or more;

hot rolling including rough rolling and finish rolling the steel material after the heating into a hot-rolled steel sheet while performing descaling at least twice between start of the rough rolling and start of the finish rolling including performing the descaling with a water pressure of 15 MPa or more once or more within 5 seconds before the start of the finish rolling, the finish rolling being performed under conditions of a finishing temperature: (RC2-50° C.) or more and (RC2+120° C.) or less and a total rolling reduction of 25% or more and 80% or less at a temperature of RC1 or less;

cooling the hot-rolled steel sheet under conditions of a time from completion of the hot rolling to start of cooling: 2.0 seconds or less, an average cooling rate: 5° C./s or more, and a cooling stop temperature: Trs or more and (Trs+250° C.) or less;

coiling the hot-rolled steel sheet after the cooling at a coiling temperature: Trs or more and (Trs+250° C.) or less; and cooling the hot-rolled steel sheet to 100° C. or less with an average cooling rate of 20° C./s or less, wherein RC1, RC2, and Trs are represented by the following formulae (2), (3), and (4), respectively, $$RC1(°\ C.)=900+100\times C+100\times N+10\times Mn+700\times Ti+5000\times B+10\times Cr+50\times Mo+2000\times Nb+150\times V \quad (2)$$

$$RC2(°\ C.)=750+100\times C+100\times N+10\times Mn+350\times Ti+5000\times B+10\times Cr+50\times Mo+1000\times Nb+150\times V \quad (3)$$

$$Trs(°\ C.)=500-450\times C-35\times Mn-15\times Cr-10\times Ni-20\times Mo \quad (4)$$

where each element symbol in the formulae (2), (3), and (4) denotes a corresponding element content (% by mass) and is 0 in the absence of the element.

8. A method for manufacturing the high-strength steel sheet according to claim 4, comprising:

heating a steel material having the chemical composition to a heating temperature of 1150° C. or more;

hot rolling including rough rolling and finish rolling the steel material after the heating into a hot-rolled steel sheet while performing descaling at least twice between start of the rough rolling and start of the finish rolling including performing the descaling with a water pressure of 15 MPa or more once or more within 5 seconds before the start of the finish rolling, the finish rolling being performed under conditions of a finishing temperature: (RC2-50° C.) or more and (RC2+120° C.) or less and a total rolling reduction of 25% or more and 80% or less at a temperature of RC1 or less;

cooling the hot-rolled steel sheet under conditions of a time from completion of the hot rolling to start of cooling: 2.0 seconds or less, an average cooling rate: 5° C./s or more, and a cooling stop temperature: Trs or more and (Trs+250° C.) or less;

coiling the hot-rolled steel sheet after the cooling at a coiling temperature: Trs or more and (Trs+250° C.) or less; and cooling the hot-rolled steel sheet to 100° C. or less with an average cooling rate of 20° C./s or less, wherein RC1, RC2, and Trs are represented by the following formulae (2), (3), and (4), respectively, $$RC1(°\ C.)=900+100\times C+100\times N+10\times Mn+700\times Ti+5000\times B+10\times Cr+50\times Mo+2000\times Nb+150\times V \quad (2)$$

$$RC2(°\ C.)=750+100\times C+100\times N+10\times Mn+350\times Ti+5000\times B+10\times Cr+50\times Mo+1000\times Nb+150\times V \quad (3)$$

$$Trs(°\ C.)=500-450\times C-35\times Mn-15\times Cr-10\times Ni-20\times Mo \quad (4)$$

where each element symbol in the formulae (2), (3), and (4) denotes a corresponding element content (% by mass) and is 0 in the absence of the element.

* * * * *